US007146654B2

(12) United States Patent
Chiang

(10) Patent No.: US 7,146,654 B2
(45) Date of Patent: Dec. 12, 2006

(54) SWIMMING GOGGLES

(76) Inventor: Herman Chiang, 11F-2 No. 634-9 Ching-Ping RD., Chung-Ho City, Taipei Hsien (TW)

( * ) Notice: Subject to any disclaimer, the term of this patent is extended or adjusted under 35 U.S.C. 154(b) by 102 days.

(21) Appl. No.: 10/852,231

(22) Filed: May 25, 2004

(65) Prior Publication Data

US 2005/0273914 A1 Dec. 15, 2005

(51) Int. Cl.
*A61F 9/02* (2006.01)

(52) U.S. Cl. ..... 2/428; 2/426; 2/427; 2/428; 2/429; 2/431; 2/435; 2/439; 2/440; 2/442

(58) Field of Classification Search ..... 2/426, 2/427, 428, 429, 431, 435, 439, 440, 442
See application file for complete search history.

(56) References Cited

U.S. PATENT DOCUMENTS 6,192,523 B1 * 2/2001 Pan ..... 2/428
6,321,390 B1 * 11/2001 Chiang ..... 2/428
6,499,148 B1 * 12/2002 Chou ..... 2/428
6,532,603 B1 * 3/2003 Lan ..... 2/428
2002/0157174 A1 * 10/2002 Chou ..... 2/428

* cited by examiner

*Primary Examiner*—Katherine Moran
*Assistant Examiner*—Alissa J. Tompkins
(74) *Attorney, Agent, or Firm*—Troxell Law Office, PLLC

(57) ABSTRACT

Swimming goggles have a left frame, a right frame and a connecting frame connecting the left frame and the right frame. The left frame and the right frame are made of hard material. Enveloping frames are respectively formed adjacent to the inner surfaces and slightly offset relative to outer rims of the peripheral surfaces. Fastener base are respectively formed on outward sides of the enveloping frames for movably receiving head strap. The connecting frame is made of soft material, and includes a nose bridge, a left pad and a right pad respectively on left and right sides of the nose bridge. Thus head strap easily move through the fastener base made of hard material, while the left pad and the right pad touch a user softly. The nose bridge supports the support portions of the left frame and the right frame reliably, so the swimming goggles are used comfortably and avoiding distortion of the left frame and the right frame.

6 Claims, 4 Drawing Sheets

SWIMMING GOGGLES

BACKGROUND OF THE INVENTION

1. Field of the Invention

The present invention relates to swimming goggles, and particularly to swimming goggles which have soft nose bridge and pads unitarily formed and integrally connecting with hard frames, wherein the nose bridge is inch-adjustable for comfortable use and is not subject to movement of head strap.

2. Related Art

As for swimming goggles, especially for swimming goggles with frames, a nose bridge and pads integrated together, comfortable touch upon a user is always taken into consideration. The frames, the nose bridge and the pads of such swimming goggles are usually made of soft material. However, the frames tend to distort when moving head strap. To overcome this problem, some swimming goggles have strengthened frames which are made of hard material and a nose bridge which is made of soft material. For example, one of conventional swimming goggles has a soft nose bridge with arc-shaped cross-section, wherein the arc has thick medium portion and thin end portion. Stop portions are provided on outsides of the frames for abutting a plate of the head strap. When pulling the head strap, pulling strength are mainly distributed on thick medium portion of the nose bridge, thereby avoiding distortion of the frames.

The nose bridge made of soft material is fixed on inner sides of the frames, and can not supports the hard frames reliably. Additionally, width of the nose bridge can not be adjusted to suit for a user's nose. The users with relatively high nose may feel uncomfortable for compression of the nose bridge.

SUMMARY OF THE INVENTION

Accordingly, an object of the present invention is to provide integral swimming goggles which have soft pads and nose bridge unitarily enveloped by hard frames, wherein the nose bridge reliably supports the frames and is inching-adjustable.

The swimming goggles comprise a left frame, a right frame and a connecting frame connecting the left frame and the right frame. The left frame and the right frame are made of hard material, and respectively include inner surfaces, outer surfaces and peripheral surfaces between the outer surfaces and the inner surfaces. Enveloping frames are respectively formed adjacent to the inner surfaces and slightly offset relative to outer rims of the peripheral surfaces. Fastener base are respectively formed on outward sides of the enveloping frames. Support portions integrally and outwardly extend from the peripheral surfaces, respectively. The connecting frame is made of soft material, and includes a nose bridge, a left pad and a right pad respectively on left and right sides of the nose bridge.

The fastener base include body defining fastener holes for movably receiving head strap, and connecting portions. The connecting portions respectively connect and space the body of the fastener base with the left frame and the right frame, thereby facilitating the connecting frame to support the left frame and the right frame.

Extending portions integrally and outwardly extend from the enveloping frames. The extending portions are integrated with and below the support portions and intersect to form at least a transition point for enhancing flexibility of the support portions.

DESCRIPTION OF THE PREFERRED EMBODIMENTS

Figure 1:
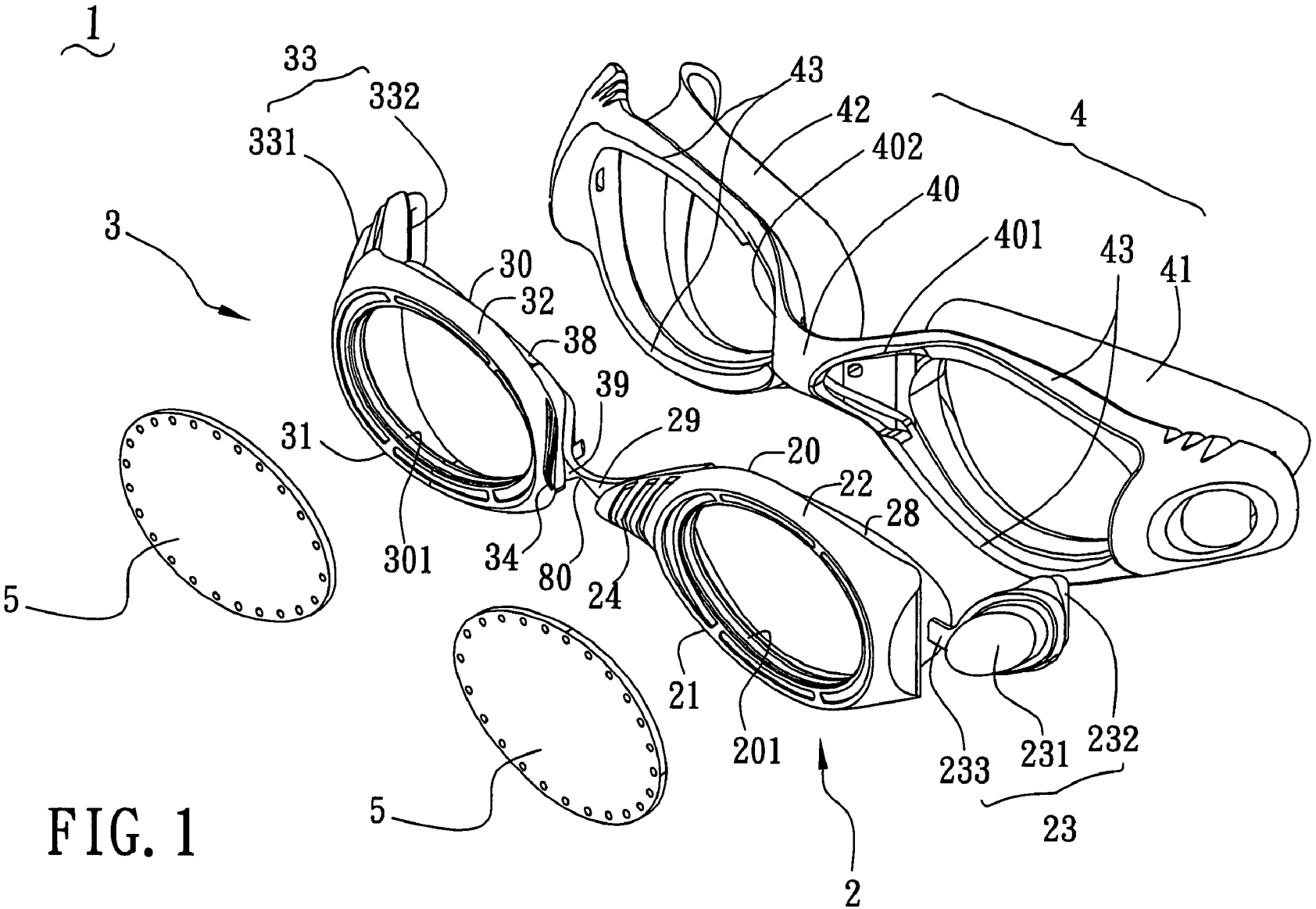
FIG. 1 is an exploded view of swimming goggles of the present invention.
Figure 5:
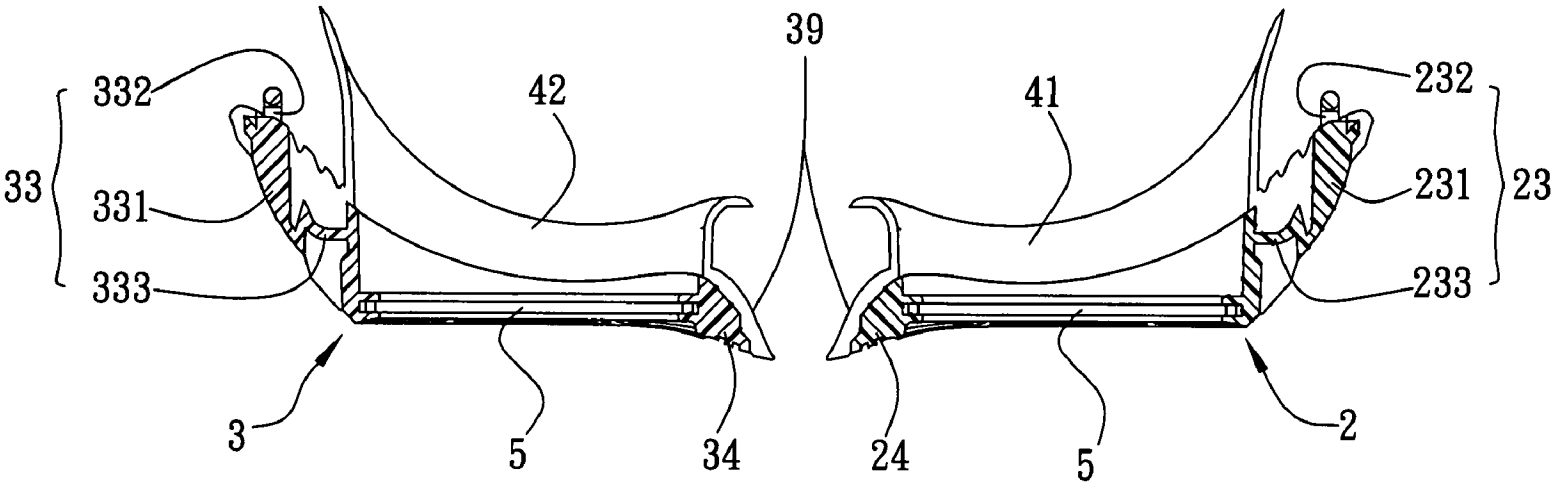
FIG. 5 is a cross-sectional view taken along the line 5—5 in FIG. 3.

With reference to FIG. 1, swimming goggles 1 of the present invention comprise a left frame 2, a right frame 3, a connecting frame 4 connecting the left frame 2 and the right frame 3 and head strap (not shown). The left frame 2 and the right frame 3 are made of hard material and respectively have inner surfaces 20, 30, outer surfaces 21, 31 and peripheral surfaces 22, 32 between the outer surfaces 21, 31 and the inner surfaces 20, 30. Receiving passages 201, 301 are respectively defined between the inner surfaces 20, 30 and the outer surfaces 21, 31 for accommodating lens 5. Enveloping frames 28, 38 are respectively formed adjacent to the inner surfaces 20, 30 and slightly offset relative to outer rims of the peripheral surfaces 22, 32. Fastener base 23, 33 are respectively formed on outward sides of the enveloping frames 28, 38 and are spaced a certain of distance from the inner surfaces 20, 30. Further referring to FIG. 5, fastener base 23, 33 include body 231, 331, and connecting portions 233, 333 respectively for connecting the fastener base 23, 33 with the left frame 2 and the right frame 3. The connecting portions 233, 333 space the body 231, 331 a distance from the inner surfaces 20, 30, thereby facilitating the connecting frame 4 to cover the enveloping frames 28, 38 of the left frame 2 and the right frame 3 securely. Fastener holes 232, 332 are respectively defined in the body 231, 331 for receiving head strap. Support portions 24, 34 integrally and outwardly extend from the peripheral surfaces 22, 32, respectively. The support portions 24, 34 are slightly inclined forwardly. Extending portions 29, 39 integrally and outwardly extend from the enveloping frames 28, 38, respectively. The extending portions 29, 39 are integrated with and below the support portions 24, 34 and intersect to form a transition point 80 for enhancing flexibility of the support portions 24, 34.

The connecting frame 4 is made of soft material, and includes a nose bridge 40, a left pad 41 and a right pad 42 respectively on left and right sides of the nose bridge 40, and a linking portion 43 integrally extending from the nose bridge 40 for connecting with the left pad 41 and the right pad 42. Assembling openings 401, 402 are respectively defined at left and right sides of the nose bridge 40 for receiving the support portions 24, 34. The linking portion 43 encircles the enveloping frames 28, 38 in assembly.

Figure 2:
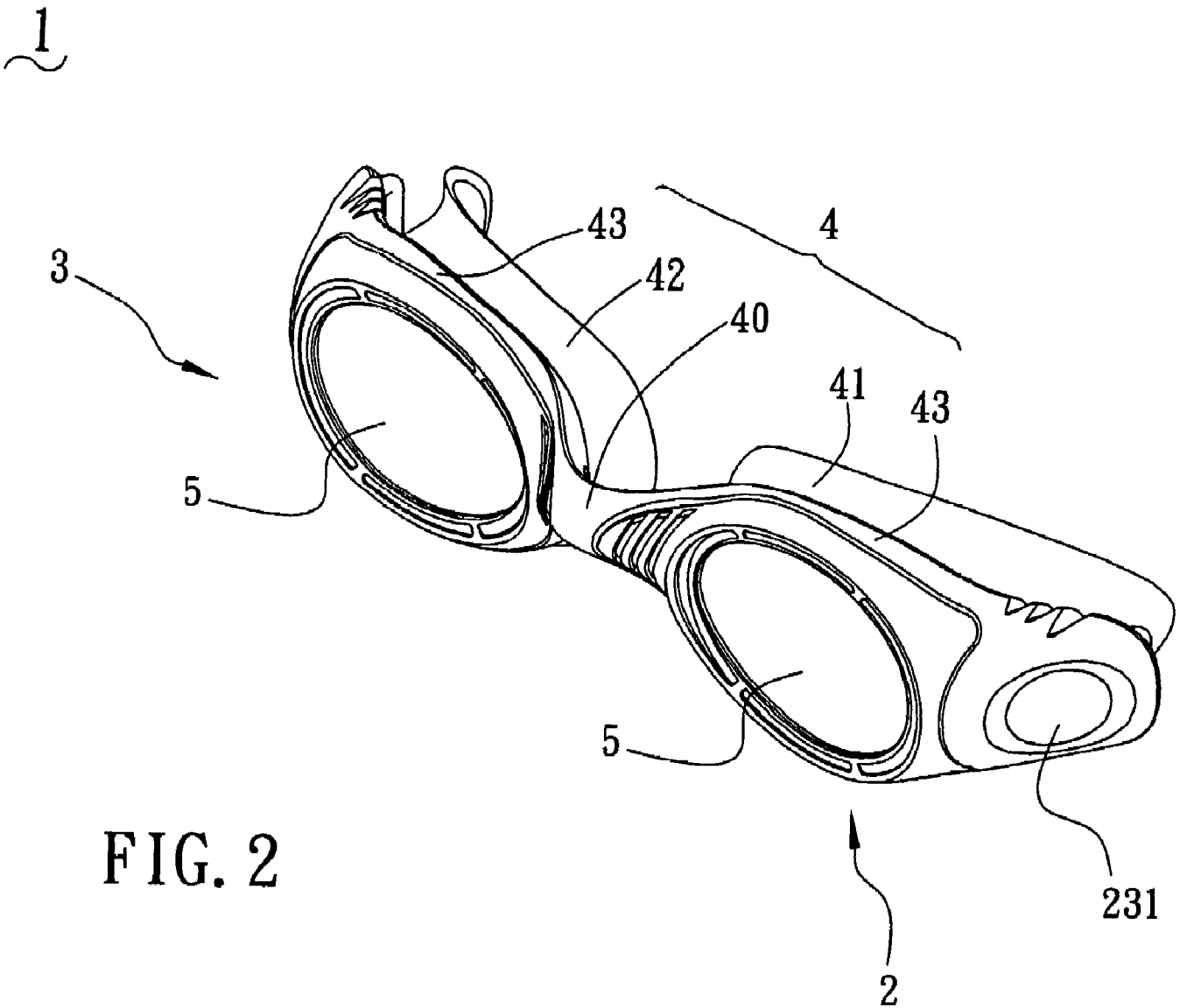
FIG. 2 is an assembled view of the swimming goggles of FIG. 1.
Figure 3:
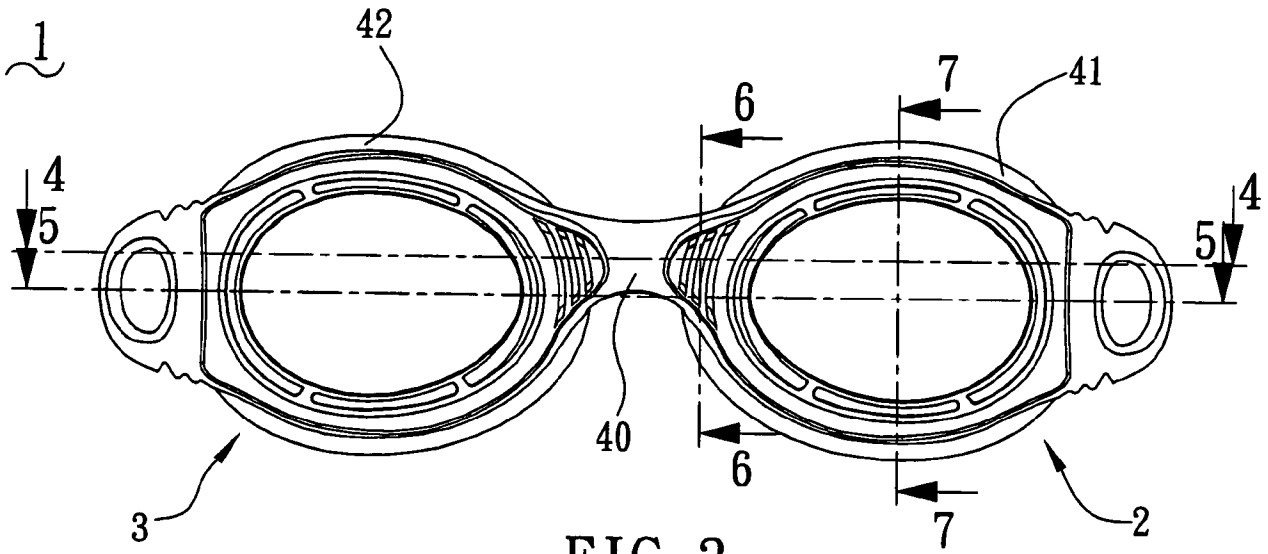
FIG. 3 is a plane view of the swimming goggles of FIG. 2.
Figure 4:
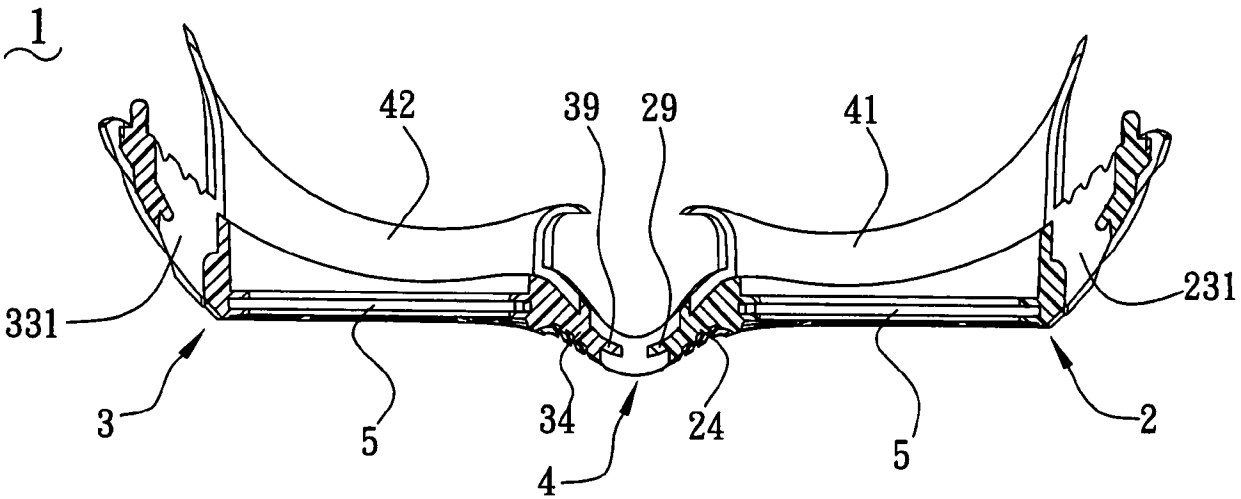
FIG. 4 is a cross-sectional view taken along the line 4—4 in FIG. 3.
Figure 7:
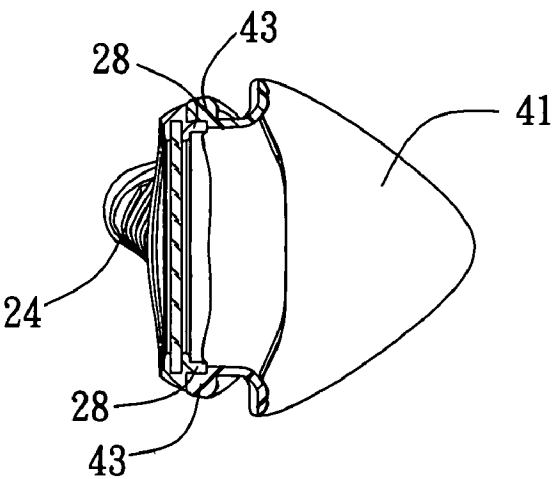
FIG. 7 is a cross-sectional view taken along the line 7—7 in FIG. 3.
Figure 6:
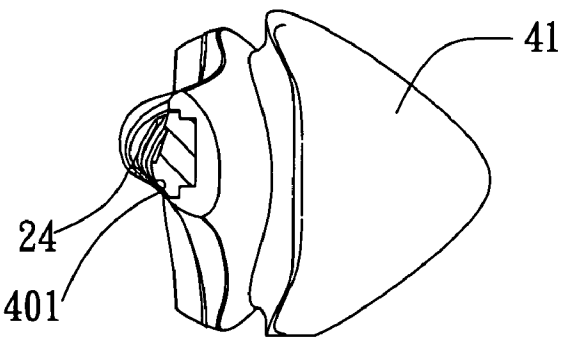
FIG. 6 is a cross-sectional view taken along the line 6—6 in FIG. 3.

With reference to FIGS. 2 and 3, in assembly, the connecting frame 4 unitarily connects the left frame 2 and the right frame 3. The nose bridge 40 surrounds the extending portions 29, 39. Further referring to FIGS. 1 and 6, the support portions 24, 34 and the extending portions 29, 39 are received in the assembling openings 401, 402 of the nose bridge 40. So the swimming goggles 1 are used comfortably and far from distortion of the left frame 2 and the right frame 3. As shown in FIG. 7, the linking portion 43 of the connecting frame 4 encircles the enveloping frames 28, 38, thereby supporting the left frame 2 and the right frame 3. The connecting portions 233, 333 produce offset between the fastener base 23, 33 and the left frame 2 and the right frame 3, whereby the connecting frame 4 encloses outer peripherals of the left frame 2 and the right frame 3 firmly. In other words, the nose bridge 40 and the left and right pads 41, 42 made of soft material enclose the left frame 2 and the right frame 3 made of hard material. Thus head strap can be easily adjusted through fastener holes 232, 332 of the left frame 2 and the right frame 3, while the left pad 41 and the right pad 42 touch a user softly.

It is understood that the invention may be embodied in other forms without departing from the spirit thereof. Thus, the present examples and embodiments are to be considered in all respects as illustrative and not restrictive, and the invention is not to be limited to the details given herein.

The invention claimed is:

1. Swimming goggles comprising:

a) a left frame and a right frame made of a hard material, each of the left frame and the right frame having:

i) an inner surface;

ii) an outer surface;

iii) a peripheral surface located between the inner surface and the outer surface;

iv) a lens located between the inner and the outer surface;

v) an enveloping frame located adjacent to the inner surface and offset relative to an outer rim of the peripheral surface;

vi) a fastener base formed on an outermost end of the enveloping frame and having a body and a fastener hole in the body; and vii) a support portion located on a peripheral surface on an end opposite the fastener base;

b) a head strap having two ends, one of the two ends is connected to the fastener holes of each of the left frame and the right frame; and c) a connecting frame made of a soft material and being connected to the left frame and the right frame, the connecting frame having:

i) a left pad;

ii) a right pad; and iii) a nose bridge located between the left pad and the right pad and having a linking portion and two assembling openings, the linking portion connecting the left pad and the right pad to the nose bridge, the linking portion encircling the enveloping frame of the left pad and the enveloping frame of the right pad, the support portion of one of the left frame and the right frame is located in each of the two assembling openings.

2. The swimming goggles according to claim 1, further comprising two extending portions forming a transition point there between, one of the two extending portions is integrally formed with and extending from each of the enveloping frame of the left frame and the enveloping frame of the right frame.

3. The swimming goggles according to claim 1, wherein the body of the fastener base is spaced apart a predetermined distance from the inner surface and the outer surface of each of the left frame and the right frame allowing the connecting frame to cover the each of the left frame and the right frame.

4. The swimming goggles according to claim 1, further comprising two connecting portions, one of the two connecting portions connecting the fastener base to each enveloping frame, wherein the body of the fastener base is spaced apart a predetermined distance from the inner surface and the outer surface of each of the left frame and the right frame allowing the connecting frame to cover the each of the left frame and the right frame.

5. The swimming goggles according to claim 1, wherein the support portion extends outwardly from the peripheral surface on the end opposite the fastener base.

6. The swimming goggles according to claim 1, wherein each of the left frame and the right frame includes a receiving passage located between the inner surface and the outer surface, an outer periphery of the lens being inserted into the receiving passage.

* * * * *